US007066278B2

(12) United States Patent
Shotey

(10) Patent No.: US 7,066,278 B2
(45) **Date of Patent: *Jun. 27, 2006**

(54) POWER TOOL AND BEAM LOCATION DEVICE

(76) Inventor: Marcus J. Shotey, 10050 E. Mt. View Lake Dr., #47, Scottsdale, AZ (US) 85258

( * ) Notice: Subject to any disclaimer, the term of this patent is extended or adjusted under 35 U.S.C. 154(b) by 0 days.

This patent is subject to a terminal disclaimer.

(21) Appl. No.: 11/024,559

(22) Filed: Dec. 28, 2004

(65) Prior Publication Data

US 2005/0115724 A1 Jun. 2, 2005

Related U.S. Application Data

(63) Continuation of application No. 10/407,493, filed on Apr. 4, 2003, now Pat. No. 6,851,487.

(51) Int. Cl.
*B25B 29/00* (2006.01)

(52) U.S. Cl. ..... 173/20; 173/171; 173/217

(58) Field of Classification Search ..... 173/1, 173/20, 217, 171; 81/52, 54; 324/67, 671
See application file for complete search history.

(56) References Cited

U.S. PATENT DOCUMENTS 2,762,970 A 9/1956 Balduman
2,772,394 A 11/1956 Bradley
2,843,821 A 7/1958 Gottlieb
4,087,913 A 5/1978 Jackson
4,099,118 A 7/1978 Franklin et al.
4,310,797 A 1/1982 Butler
4,388,890 A 6/1983 Wester et al.
4,464,622 A * 8/1984 Franklin ..... 324/67
4,700,489 A 10/1987 Vasile
5,222,303 A 6/1993 Jardine
5,484,026 A 1/1996 Susaki et al.
5,500,783 A 3/1996 Warda et al.
5,512,834 A 4/1996 McEwan
5,562,240 A 10/1996 Campbell
6,188,228 B1 2/2001 Philipp
6,211,662 B1 4/2001 Bijawat et al.
6,269,996 B1 8/2001 McAllister
6,301,997 B1 10/2001 Welte
6,334,743 B1 * 1/2002 Liao ..... 408/16
6,851,487 B1 * 2/2005 Shotey ..... 173/1
6,926,473 B1 * 8/2005 Luebke ..... 408/16

* cited by examiner

*Primary Examiner*—Rinaldi I. Rada
*Assistant Examiner*—Nathaniel Chukwurah
(74) *Attorney, Agent, or Firm*—Booth Udall, PLC

(57) ABSTRACT

A power tool having a location sensor for identifying beams or studs behind a wall. Wherein the location sensor is moveably attached to the power tool between advanced and retracted position such that when the center portion of the stud is located, the power tool work implement, whether it be a drill, nail, screwdriver or the like is located to engage a central portion of a hidden beam.

14 Claims, 8 Drawing Sheets

POWER TOOL AND BEAM LOCATION DEVICE

CROSS REFERENCE TO RELATED APPLICATION

This application is a continuation of the earlier patent application entitled "Power Tool and Beam Location Device", Ser. No. 10/407,493, filed Apr. 4, 2003, now U.S. Pat. No. 6,851,487, the disclosure of which is hereby incorporated herein by reference.

BACKGROUND OF THE INVENTION

1. Technical Field

This invention generally relates to a device and method for locating a hidden object, such as a beam behind a wallboard and simultaneously activating a power tool to engage the hidden object with a work implement.

2. Background Art

In construction, it is common to need to locate a hidden object such as a beam or a stud behind a wall as part of the construction process. Location sensors, commonly referred to as stud finders, have been developed to accomplish this purpose. In normal operation, stud finders are used to locate a hidden beam or stud and the area is then marked with a pencil. Thereafter, a power tool, such as a drill or a nail gun, is used to direct a drill bit, screw, nail or other implement through the wallboard into the hidden beam or stud.

During most construction projects, this process is repeated many times and the construction worker needs to have handy at all times the stud finder, marking implement, such as a pencil, and the appropriate power tool, drill or nail gun. Unfortunately, stud finders are often misplaced, pencils or other marking implements break or are no longer sufficient for marking the wall and the power tools must be laid down as the other steps are performed. When such power tools are laid down, they may fall, which can be especially dangerous if the work is being done from a scaffolding. In addition, such implements may be a further hazard as individuals can trip over them.

DISCLOSURE OF INVENTION

According to the present invention a hand-held power tool, such as a drill or a nail gun, has mounted on it a location sensor, commonly referred to as a stud finder. The location sensor is secured to the power tool such that the portion of the sensor which is used to locate the hidden stud is aligned with the center line of the power tool receptacle in which the work implement, such as a drill bit, or screwdriver resides or out of which the nail is expelled.

The location sensor may be slidably connected to the tool so as to be advanced to engage the wall behind which lies the beam which is being sought. The friction of the slide may be such that once the item is located, the tool may be advanced to the wall such that the tool itself engages the wallboard and the location sensor is slid toward a retracted position. Sliding toward a retracted position, the tool may be used to advance the drill bit into the beam or the tool may engage the wallboard such that a nail may then be fired through the wallboard into the beam. The location sensor may be biased toward the advanced position by a spring or other means so as to be ready for its next use once the tool is removed from the wallboard. Furthermore, the top of the sensor may have a receptacle like configuration to catch debris when drilling.

The foregoing and other features and advantages of the invention will be apparent from the following more particular description of embodiments of the invention, as illustrated in the accompanying drawings.

BRIEF DESCRIPTION OF DRAWINGS

The embodiments of the present invention will hereinafter be described in conjunction with the appended drawings, where like designations denote like elements.

MODES FOR CARRYING OUT THE INVENTION

Figure 1:
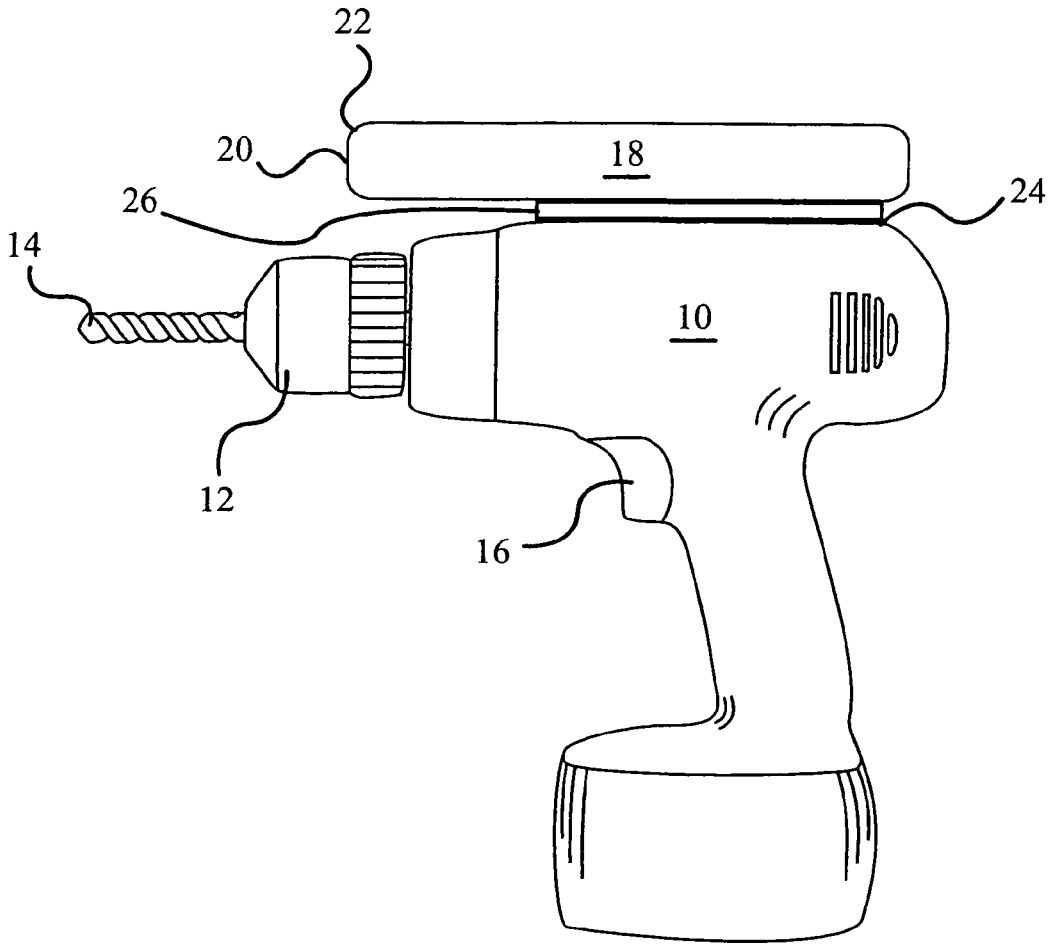
FIG. 1 is a side elevational view of the power tool with mounted location sensor.

According to the present invention as disclosed in FIG. 1, a hand-held power tool 10, which for illustration purposed is shown as a standard drill, has a chuck 12 for holding a drill bit 14. The drill bit 14 may suitably be any other work implement, including a screwdriver, tapping tool or any device adapted to be secured in a chuck. Also, the power tool 10 could be a nail gun, in which case instead of a chuck there would simply be an exit receptacle through which a nail would be propelled. The power tool has a switch 16 for activating the power tool.

Mounted on the power tool 10 is a location sensor 18. The location sensor is of a type commonly referred to as a stud finder and may be any type or model including the type described in U.S. Pat. No. 4,099,118, issued to Franklin, et al. It should be appreciated that the location sensor 18 could be mounted to the power tool in a number of different ways or could even be built into the tool. The location sensor has a sensor face 20 located toward a first end 22 of the location sensor 18. As shown in FIG. 1, the location sensor may be mounted to the top 24 of the power tool 10 by a slide mechanism 26, which will be described more fully in later drawings.

Figure 2:
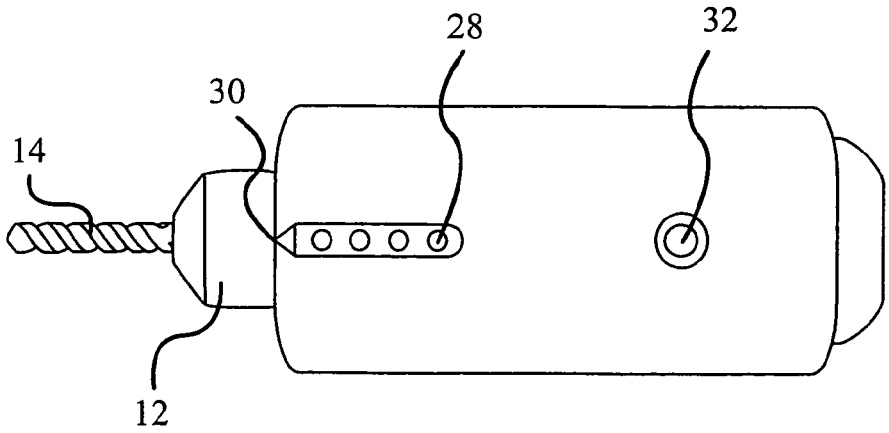
FIG. 2 is a top plan view of the invention.

As shown in FIG. 2, which is a top plan view, the location sensor 18 may have a plurality of indicator lights 28 and a centering arrow 30. The location sensor 18 may have an on/off button 32. It should be appreciated that if the sensor is built into the power tool, the on/off button 32 could be located in a more convenient place such as adjacent to the switch 16. As the location sensor is moved along the wall, the indicator lights will light in order, and when all four lights are illuminated the sensor is directly over the hidden beam or stud. Moving the location sensor from side to side will locate the ends of the stud and confirm where the center of the stud is located, which should be substantially in front of the centering arrow 30.

Figure 5:
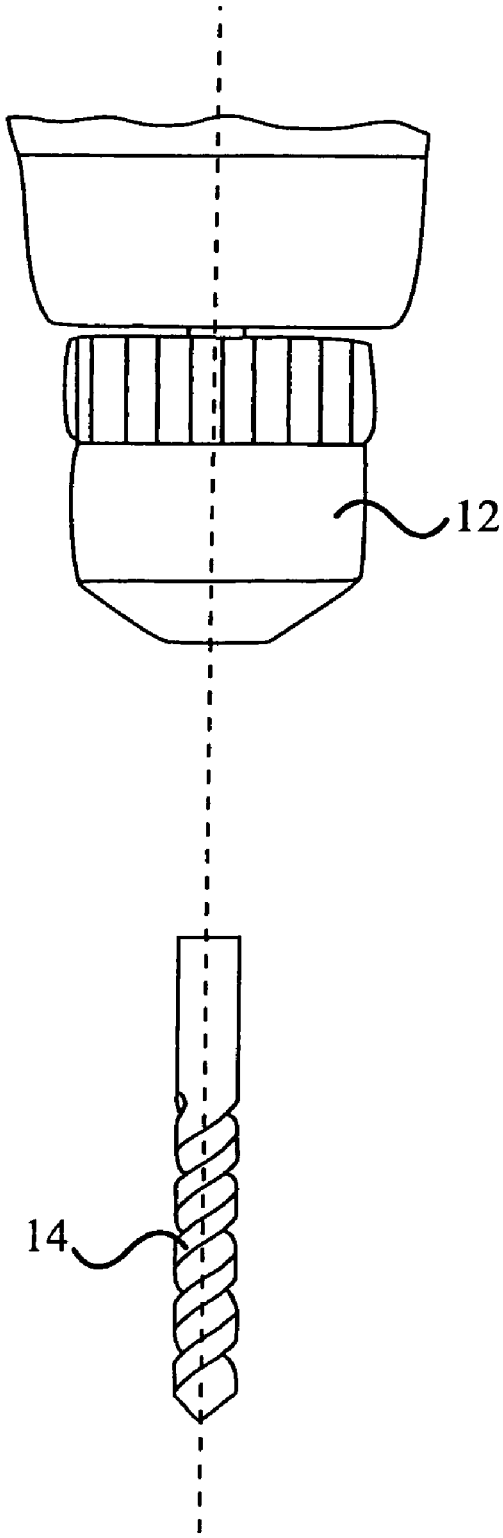
FIG. 5 is a top plan view of the invention in partial break away, showing the tool on a work implement.

The centering arrow 30 is also directly over the centering line of the chuck 12 and a center line of the work implement 14. As shown in FIG. 5, the center line 34 traverses the center of the work implement 14, and the center of the chuck 12. Thus, when the location sensor indicates that a center portion of hidden beam has been located, the work implement, be it a drill bit, nail or other implement, will be aligned to engage the center portion of the beam as long as the power tool 10 is held in a substantially upright position and not cantered significantly to either side.

Figure 3:
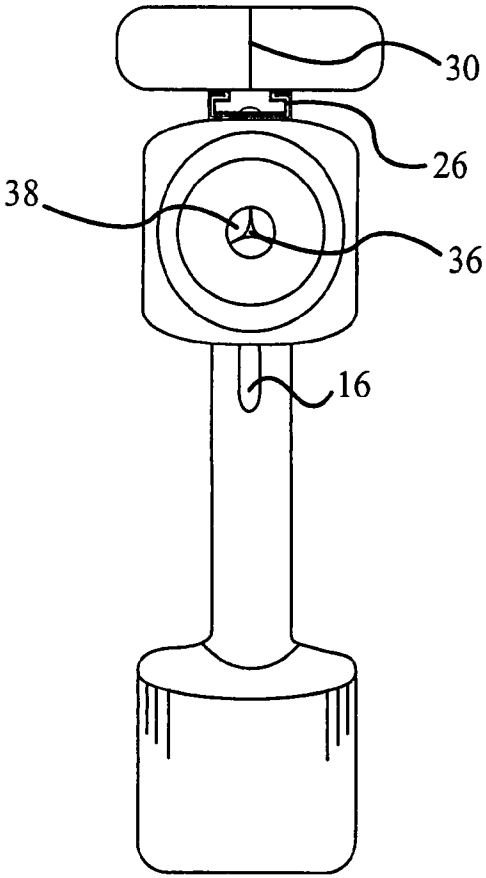
FIG. 3 is a front elevational view of the invention.

As shown in FIG. 3, the center 36 of the chuck 12 lies in the same vertical plane as the centering arrow 30. Thus, the receptacle 38 which receives the work implement 14 has the center portion 36 aligned in the same vertical plane as the centering arrow 30. Where the power tool 10 shown is a nail gun, the receptacle 38 would be the opening through which the nail would exit and the center 36 of the exit opening would conform to the center portion of the nail. Thus, whatever work implement or projectile is used, when the hand-held power tool 10 is held in an upright position, the center 36 lies in the same vertical plane as the arrow 30 and the tool projectile may be propelled toward the center portion of the hidden beam.

Figure 4:
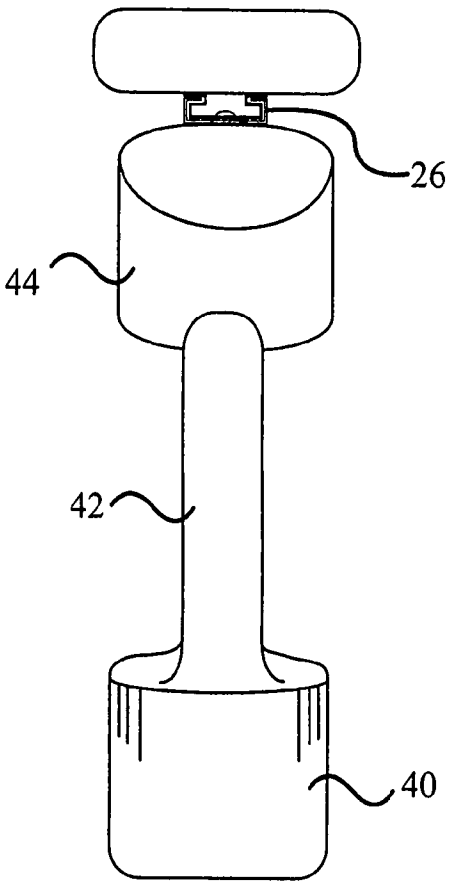
FIG. 4 is a rear elevational view of the invention.

FIG. 4 shows a rear elevational view of the power tool having a base 40, handle 42, and a body 44. Attached to the top of the body 44 is the slide mechanism 26.

Figure 6:
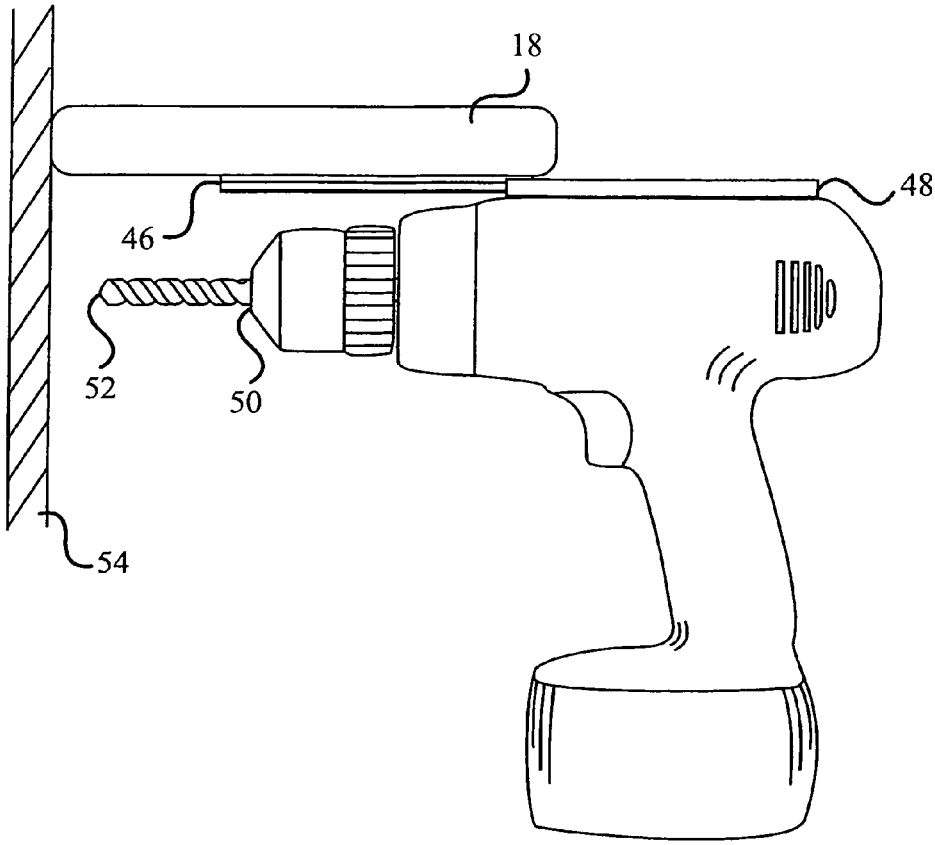
FIG. 6 is a side elevational view showing the sensor in its advanced position.

As shown in FIG. 6, the location sensor 18 is secured to a slide insert 46 which slidably engages the base 48 of the slide mechanism 26. Thus, the location sensor may be moved between an advanced position as shown in FIG. 6 and a retracted position as shown in FIG. 1. By being moveable and disengagably secured in its advanced position, the sensor face 20 extends between 2 to 5 inches beyond the front face 50 of the chuck 12. It should be appreciated that the degree to which the sensor is extended beyond the front base of the chuck is determined by the size of the work implement 14. Thus, where exceptionally long work implements are used, the slide mechanism 26 could be further telescoping so that the sensor face 20 extends beyond the engagement tip 52 of the work implement 14. It should also be appreciated that where the power tool is a nail gun the sensor face need only extend as far as the opening to the receptacle 38 through which the nail would exit so that the receptacle would be flush with the wall 54 when the sensor face 20 engaged the wall.

Figure 7:
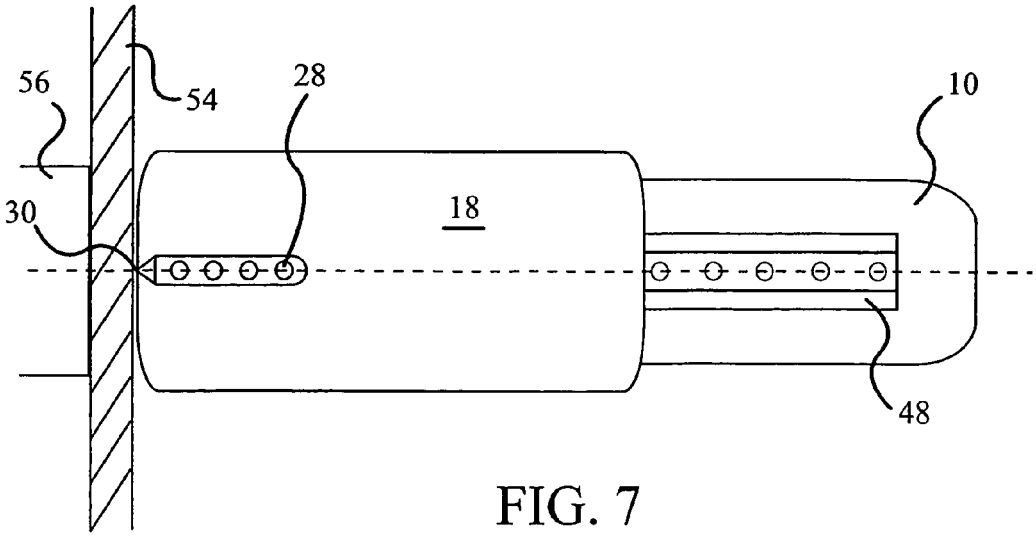
FIG. 7 is a top plan view showing the sensor in advanced position.

As shown in FIG. 7, when the sensor 18 locates the center of the beam 56, the alignment is such that the centering arrow 30 and the center line 34 correspond substantially with the central portion of the beam 56.

Figure 8A:
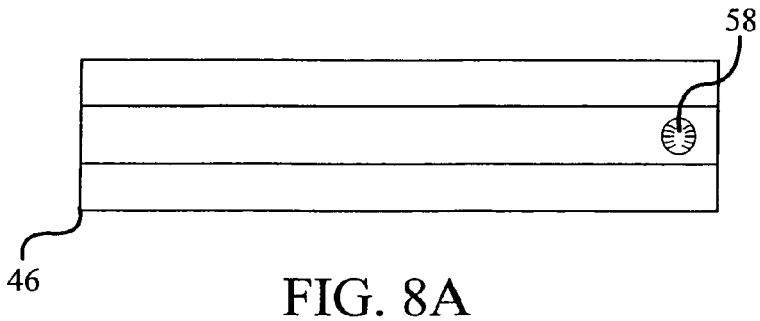
FIG. 8A is a plan view one half of the slide mechanism.
Figure 8B:
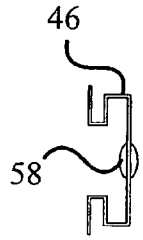
FIG. 8B is an elevational view taken from the end of FIG. 8A.

FIGS. 8A through 10 disclose a possible slide mechanism 26. FIG. 8A discloses the slide insert 46. At one end of the slide insert is a ball 58 which is biased outwardly. As shown in FIG. 8B, the ball extends outwardly from the base 60 of the slide insert 46. As shown in FIG. 9A, the base of the slide mechanism 48 has a plurality of indents 62, which form a number of disengagable stops for partially restraining the ball 58 as the slide insert 46 is moved along the base of the slide mechanism 48. This is a typical detent type construction and due to the fact that the ball 58 has rounded surfaces pushing on the location sensor 18, which is attached to the slide insert 46, will move the ball 58 from one indent 62 to the next. It is also possible to simply slide the insert 46 out of the base 48 so that the location sensor can be used independently.

Figure 9A:
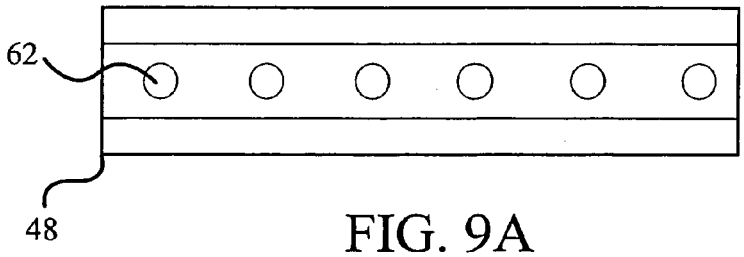
FIG. 9A is a plan view of the other half of the slide mechanism.
Figure 9B:
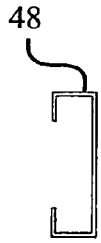
FIG. 9B is an end elevational view of FIG. 9A.
Figure 10A:
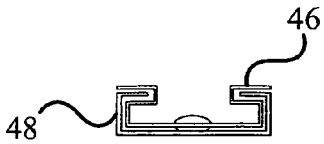
FIG. 10A is an end elevational view showing the engagement of the two halves of the slide mechanism.
Figure 10B:
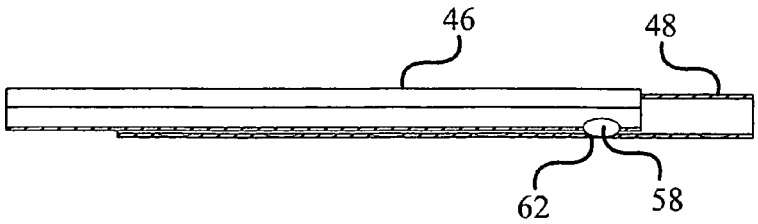
FIG. 10B is side elevational view in break away showing the interaction of the slide mechanism element.
Figure 11:
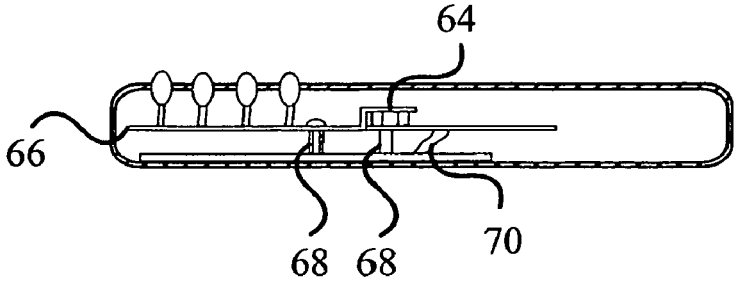
FIG. 11 is a break away view of the sensor.

As shown in FIG. 9B, the base of the slide mechanism 48 forms a channel into which the slide insert 46 may be inserted as shown in FIG. 10A. FIG. 10B shows how the ball 58 will reside in the indent 62 and may be moved from one indent to the next. As shown in FIG. 11, the sensor may have a circuit board 64, which has a sensor tip 66, which is centrally located within the location sensor 18 and may be referred to as the central sensor. The sensor may have various support posts 68 to hold the sensor tip in the correct position. In addition, various energy sources (not shown) would be connected by some type of cable 70 to power the sensor. It should be appreciated that while one particular sensor or stud finder is disclosed, any device that functions to locate an item behind a wall would be suitable.

Figure 12:
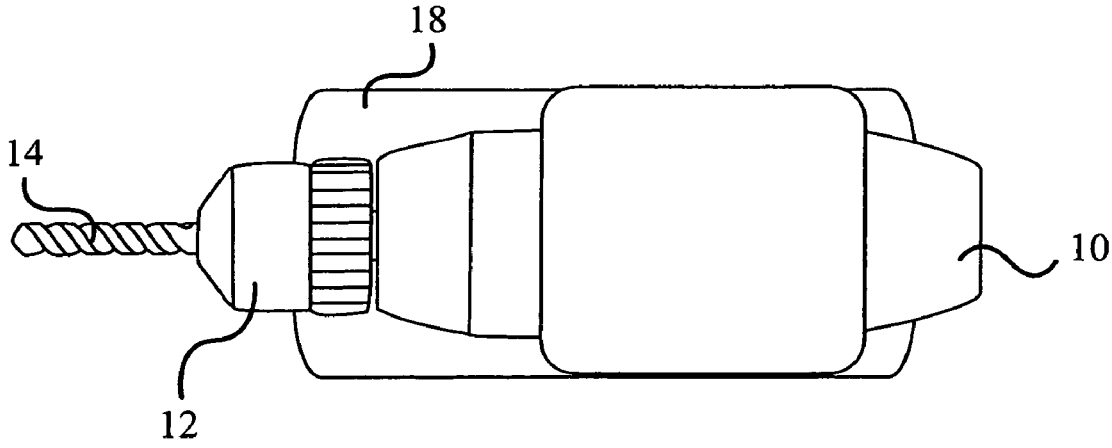
FIG. 12 is a rear elevational view of the invention.
Figure 13:
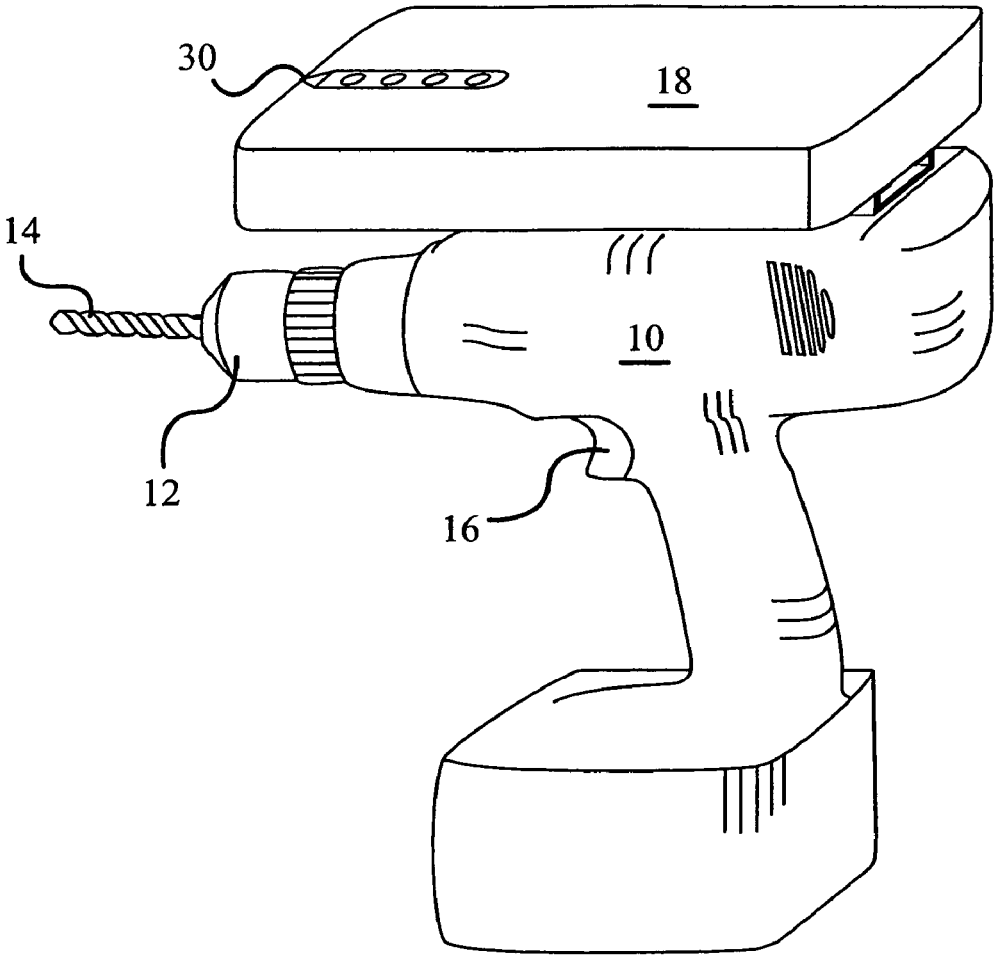
FIG. 13 is a prospective view of the invention.

FIG. 12 is a bottom plan view of the invention showing the positional relationship between the sensor and the power tool. FIG. 13 is a prospective view which shows the location sensor 18 secured to the slide mechanism located along the top of the body 44 of the power tool.

In operation, one would move the location sensor 18 to its advanced position as shown in FIG. 6. In the advanced position, the sensor face 20 would engage the wall 54 and would extend beyond the engagement tip 52 of the work implement 14. On/off button 32 would be activated to turn on the sensor and the sensor would be moved along the wall 54 until a stud 56 is located. Upon locating stud 56, the indicator lights 28 would light up in sequence such that when a plurality of lights or all four are lit, a central portion of the beam 56 would lie in front of the centering arrow 30. To confirm the center, one may slide the sensor face 20 past the beam so as to locate both sides of the beam and quickly confirm that the center has been located.

The individual would then engage the switch 16 to activate the power tool and, if the power tool were a drill, the work implement 14 would be advanced toward the wall, which would simultaneously slide the sensor back toward its retracted position as shown in FIG. 1.

Where the power tool is a nail gun, the sensor face 20 would be moved to its advanced position wherein the sensor face would engage the wall 54 while the receptacle 38 was also engaged or in close proximity to the wall. Thus, when the center portion of the beam 56 was located, the switch 16 could be engaged and the nail expelled through the center portion of the receptacle 38, through the wall 54 and into a central portion of the beam 56.

Figure 14:
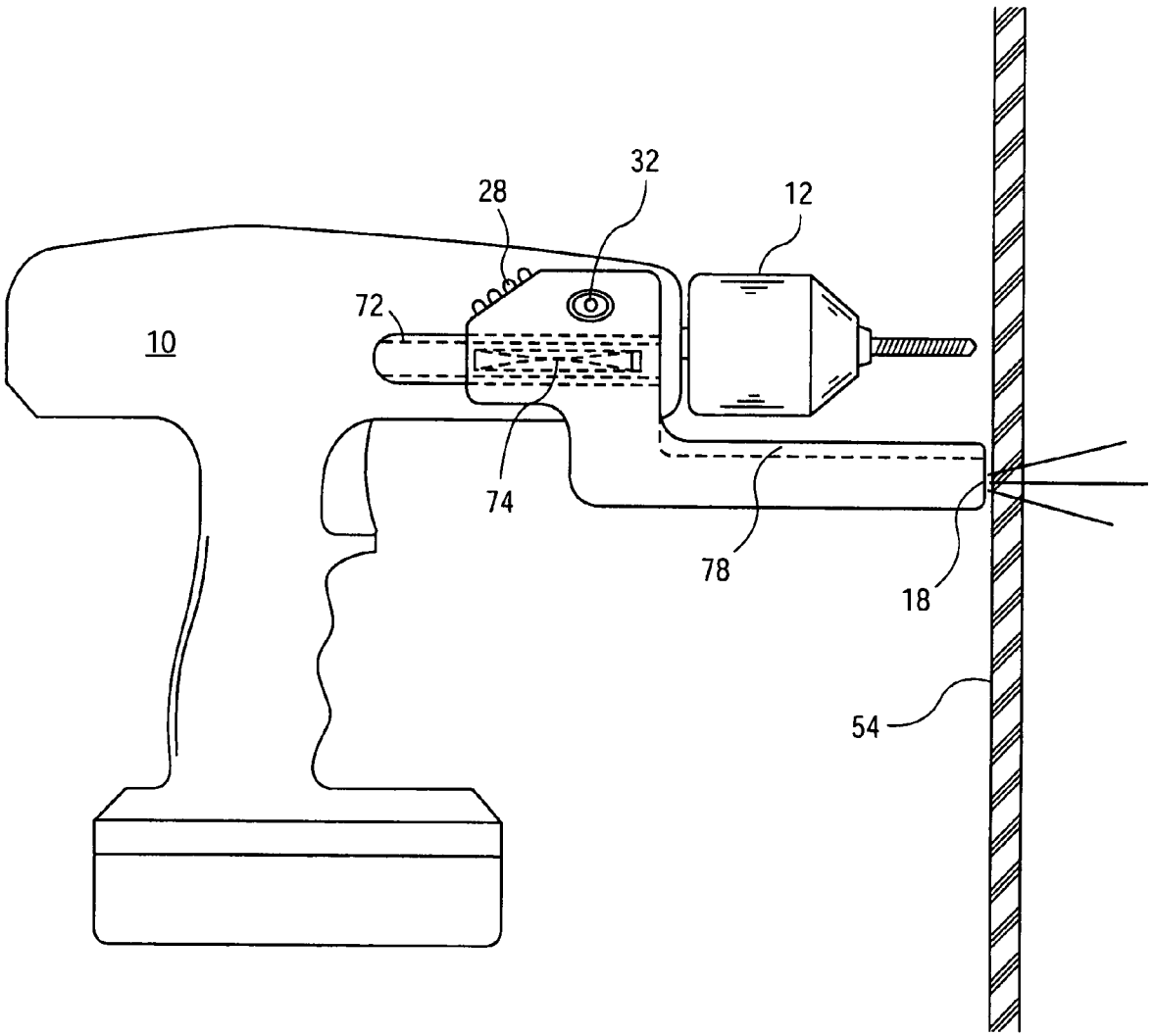
FIG. 14 is a side elevational view of an alternate embodiment.

In another embodiment as shown in FIG. 14 the sensor 18 is slidable mounted below the chuck 12 in a rail 72 in the side of the power tool 10. A spring 74 biases the sensor 18 toward the advanced position as shown. In this embodiment the top of the sensor 18 may have a container 78 so that debris from the drilling can be caught in container 78. Also, the biasing while allowing the sensor to move to the retracted position as the drill is advanced will assure contact between the sensor 18 and the wallboard 54 as the drill bit is removed further assuring that the debris will fall into container 78.

Although the above describes embodiments of the invention it should be appreciated that the scope of the invention is intended to be limited only by the appending claims. Furthermore, numerous variations may be made to one or more of the disclosed embodiments without departing from the spirit of the invention and claimed scope thereof.

I claim:

1. A hand-held power drill comprising:

an adjustable receptacle, adaptable to receive a work implement, the receptacle having a centerline defining the center of the receptacle and extending the length of the receptacle; and a covered object location sensor having a central sensor portion configured to locate the presence of a covered object, the sensor moveably coupled to the power drill between an advanced and a retracted position such that in the advanced position the covered object location sensor central sensor portion is configured to align with a covered object located behind a cover near the adjustable receptacle, and the receptacle centerline can be visually aligned in substantially the same plane as the central sensor portion.

2. The hand-held power drill of claim 1, further comprising a slide mechanism for moving the location sensor between the advanced and a retracted position.

3. The hand-held power drill of claim 2, wherein the slide mechanism has a detent, said detent being a plurality of indents and a ball biased to extent into the selected indents.

4. The hand-held power drill of claim 3, wherein the resistance to disengaging the ball from a selected indent may be overcome by pressing the location sensor against a wall while the power drill is being operated.

5. The invention of claim 2, wherein the sensor is biased toward the advanced position.

6. The hand-held power drill of claim 1, wherein the location sensor may be disengageably secured at various locations between the advanced and retracted position.

7. The hand-held power drill of claim 6, wherein the location sensor is adapted to be disengaged from the power drill.

8. A hand-held power drill comprising:

a handle;

a switch for activating the power drill;

an adjustable receptacle, adapted to receive a work implement substantially centrally located in the receptacle, the receptacle having a centerline which substantially conforms with the center of the work implement when in the receptacle;

a covered object location sensor adapted to identify a target area toward the center of the covered object; the sensor disengagably coupled to the power drill such that the sensor can be moved between an advanced position near a distal end of the work implement and a retracted position away from the distal end of the work implement.

9. The power drill of claim 8, wherein the sensor has a sensor face toward an end of the sensor and the sensor is moveably secured to the power drill for movement between the advanced and the retracted position; the power drill having a body coupled to the handle wherein the body has a front end in which is located the front receptacle and wherein the sensor face extends at least up to the front end of the tool when in its advanced position.

10. The power drill of claim 9, wherein the sensor face extends at least 1.5 inches beyond the front end of the tool when in its advanced position.

11. The power drill of claim 10, wherein the sensor is slidably secured to the tool.

12. The power drill of claim 8, wherein a slide mechanism for securing the sensor to the tool has a plurality of disengagable stops for partially restraining the movement of the sensor at predetermined positions between the advanced and retracted positions.

13. The invention of claim 12, wherein the slide mechanism has a detent, the detent being a plurality of indents and a ball based to extend into the selected indents.

14. The power drill of claim 8, wherein the sensor is completely disengagable from the power drill such that it can be used separately from the power drill.

* * * * *